US006812845B2

(12) United States Patent
Yuzuki

(10) Patent No.: US 6,812,845 B2
(45) Date of Patent: Nov. 2, 2004

(54) BODY-MOUNTED ELECTRONIC DEVICE SYSTEM AND BODY-MOUNTED ELECTRONIC DEVICE

(75) Inventor: Toshiyuki Yuzuki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 22 days.

(21) Appl. No.: 10/358,820

(22) Filed: Feb. 5, 2003

(65) Prior Publication Data

US 2003/0151515 A1 Aug. 14, 2003

(30) Foreign Application Priority Data

Feb. 13, 2002 (JP) ..... 2002-035534

(51) Int. Cl.[7] ..... G08B 23/00

(52) U.S. Cl. ..... 340/573.1; 340/573.4; 340/5.2; 340/5.8

(58) Field of Search ..... 340/573.4, 573.1, 340/573.3, 5.2, 5.8, 669, 686.1, 323 R; 600/503, 534, 552, 510

(56) References Cited

U.S. PATENT DOCUMENTS 5,883,576 A * 3/1999 De La Huerga ..... 340/573.1
6,616,607 B2 * 9/2003 Hashimoto et al. ..... 600/300
6,700,499 B2 * 3/2004 Kubo et al. ..... 340/686.1
6,714,133 B2 * 3/2004 Hum et al. ..... 340/573.4

* cited by examiner

*Primary Examiner*—Anh V. La
(74) *Attorney, Agent, or Firm*—Adams & Wilks

(57) ABSTRACT

A body-mounted electronic device system enabling the user to grasp the conditions of other runners. A master unit and a child unit are mounted on a runner, and a child unit is mounted on another runner. Counting units of the child units count the numbers of steps of the runners at predetermined time intervals, and transmit the data together with their own identification data to the master unit. When the received identification data are in agreement with the identification data stored in an ID setting/storage unit, the reception comparator unit calculates the moving distances of the runners based upon the received step number data, and an among-the-child-units-distance calculation unit calculates the distances among the child units. The distances among the child units that become smaller than a reference distance stored in a preset distance storage unit are notified through a buzzer and a display unit.

21 Claims, 9 Drawing Sheets

Prior Art

BODY-MOUNTED ELECTRONIC DEVICE SYSTEM AND BODY-MOUNTED ELECTRONIC DEVICE

BACKGROUND OF THE INVENTION

This invention relates to a body-mounted electronic device used by being mounted on human body or on clothing and to a body-mounted electronic device system using the body-mounted electronic device.

There have heretofore been developed body-mounted electronic device systems using body-mounted electronic devices such as pedometers or the like.

FIG. 10 is a block diagram of a conventional body-mounted electronic device system disclosed in JP-A-2001-12966. The body-mounted electronic device system is constituted by a pedometer 1 that can be mounted on a waist belt of a user and a wrist watch 2 that can be mounted on an arm.

In FIG. 10, the user mounts the pedometer 1 on the waist belt and mounts the wrist watch 2 on his arm. In starting the walking, the user operates a set key provided on the pedometer 1 to initialize the step number data to "0" in a step number-counting unit 4. The user further operates a target step number input key of the wrist watch 2 to input a target step number, and to store the target step number in a target step number area.

When the user starts walking, a transmission unit 5 in the pedometer 1 transmits the step number data output from the step number-counting unit 4 and identification data (ID) stored in a memory 6. Based on the time data sent from a counter circuit 17, on the other hand, a central processing unit (CPU) 7 in the wrist watch executes a processing for displaying the present time on a display unit 12 and executes a processing based on a program.

First, a data reception processing is executed to take in the step number data and the ID received by a receiver unit 10.

Then, it is judged whether the ID that is taken in is in agreement with an ID that has been stored in a ROM 8. When they are not in agreement, the subsequent processing related to the step number data ends. Therefore, even in case somebody near him is carrying a similar portable electronic device system and the data are being transmitted from the above somebody's pedometer 1, it never happens that incorrect processing is executed based on the somebody's step number data.

When the ID is in agreement and the step number data is being transmitted from the pedometer 1 of the user U, the step number data is compared with the step number data that has been stored already in the step number area thereby to judge whether there is a change in the step number data that is transmitted. When there is no change, the step number data stored in the step number area is not updated.

When there is a change in the step number data, the step number data stored in the step number area is updated to the step number data that is received, and the number of steps based on the updated step number data is displayed on a display unit 12. Therefore, the display unit 12 displays the number of steps together with the present time that has been continuously displayed.

Next, it is judged whether the walking distance key is turned on. When it is turned on, the walking distance is calculated based upon the step number data stored in the step number area, and the walking distance that is calculated is stored in a waking distance area and is, then, displayed on the display unit 12. Then, the display unit 12 displays the present time as well as the distance traveled by walking up to this moment.

It is further judged whether a consumed calorie key is turned on. When it is turned on, the consumed calorie is calculated based on the step number data stored in the step number area, and the consumed calorie that is calculated is stored in a consumed calorie area and is displayed on the display unit 12. Therefore, the display unit 12 displays the calorie that is consumed after the start of walking together with the present time.

Next, it is judged whether the number of steps stored in the step number area has reached a target number of steps stored in a target step number area. A vibration motor 11 is operated when it has reached the target step number. Therefore, the user is allowed to recognize the achievement of the target number of steps due to vibration from the wrist watch 2 and to make sure the achievement of the target number of steps relying on the number of steps that is displayed.

According to the body-mounted electronic device system as described above, it is allowed not only to count and display the number of steps but also to display the distance traveled by walking, consumed calorie and the present time, and to notify the achievement of the target number of steps.

However, the above conventional body-mounted electronic device system simply uses one wrist watch 2 and one pedometer 1, but no consideration has been given to that the system may have been used by a plurality of users simultaneously.

Therefore, when a plurality of users compete the walking race or marathon race with each user wearing the wrist watch 2 and the pedometer, then, the user must look back to make sure the positions and distances of other users, often resulting in the collapse of the running form.

Besides, since the speeds of other users are not obvious, a problem is always involved such as the user is unable to estimate the time until he catches up another user or to estimate the time until he is caught by another user.

SUMMARY OF THE INVENTION

This invention is to make it possible to grasp the conditions in which other competitors are placed.

The invention further makes it possible to confirm the relationship between the user and the other competitors.

According to this invention, there is provided a body-mounted electronic device system including a master unit and a plurality of child units that can be mounted on the bodies, wherein the master unit comprises first communication means for executing radio communication with the plurality of child units, first identification data storage means for storing identification data of the plurality of child units, identification data judging means for judging whether the identification data received from the plurality of child units are in agreement with the identification data of child units stored in the first identification data storage means, distance calculation means for calculating distances among the plurality of child units from moving quantity data received from the plurality of child units, and notifying means for notifying the distances among the child units, each of the plurality of child units comprises second communication means for executing radio communication with the master unit, moving quantity-measuring means for measuring the moving quantity corresponding to its own moving distance, and second identification data storage means for storing its own identification data, each of the plurality of child units transmits its own moving quantity data measured by the moving quantity-measuring means together with its own identification data to the master unit through the second communication means, and when the identification data judging means has judged that the identification data received from the plurality of child units are in agreement with the identification data stored in the first identification data storage means, the master unit causes the distance calculation means to calculate the distances among the child units based upon the moving quantity data from the plurality of child units received through the first communication means, and notifies the distances among the child units through the notifying means.

The plurality of child units transmit their own moving quantity data measured by moving quantity-measuring means together with their own identification data to the master unit through the second communication means. When the identification data judging means has judged that the identification data received from the plurality of child units are in agreement with the identification data stored in the first identification data storage means, the master unit causes the distance calculation means to calculate the distances among the child units based upon the moving quantity data from the plurality of child units received through the first communication means, and notifies the distances among the child units through the notifying means.

Here, the distance calculation means may include moving distance calculation means for calculating absolute distances which are the moving distances of the plurality of child units from the start position, and among-the-child-units-distance calculation means for calculating the distances among the child units from the differences in the absolute distances of the plurality of child units calculated by the moving distance calculation means.

It is further allowable to provide distance comparator means for comparing a predetermined reference distance with the distances among the child units, and when the distance comparator means has detected the distances among the child units that are smaller than the reference distance, the notifying means notifies this fact.

It is further allowable to provide operation means for setting the reference distance and reference distance storage means for storing the reference distance set by the operation means, and when the distance comparator means has detected that the distances among the child units are in agreement with the reference distance, the notifying means notifies this fact.

Further, the reference distance is constituted by a first reference distance and a second reference distance, the distance comparator means produces a first notice signal when the distances among the child units become smaller than the first reference distance, produces a second notice signal when the distances among the child units become smaller than the second reference distance, and the notifying means notifies this fact in different modes in response to the first and second notice signals.

According to this invention, further, there is provided a body-mounted electronic device system including a master unit and a plurality of child units that can be mounted on the bodies, wherein the master unit comprises first communication means for executing radio communication with the plurality of child units, first identification data storage means for storing identification data of the plurality of child units, identification data judging means for judging whether the identification data received from the plurality of child units are in agreement with the identification data of child units stored in the first identification data storage means, difference-of-speed calculation means for calculating differences in the speed among the plurality of child units based on the moving quantity data received from the plurality of child units, estimated catch-up time calculation means for calculating an estimated catch-up time until any child unit catches up another child unit based upon the distances among the child units and the difference of speed among the child units, and notifying means for notifying the estimated catch-up time, each of the plurality of child units comprises second communication means for executing radio communication with the master unit, moving quantity-measuring means for measuring the moving quantity corresponding to its own moving distance, and second identification data storage means for storing its own identification data, each of the plurality of child units transmits its own moving quantity data measured by the moving quantity-measuring means together with its own identification data to the master unit through the second communication means, and when the identification data judging means has judged that the identification data received from the plurality of child units are in agreement with the identification data stored in the first identification data storage means, the master unit causes the estimated catch-up time calculation means to calculate the estimated catch-up time based upon the moving quantity data from the plurality of child units received through the first communication means, and notifies the estimated catch-up time through the notifying means.

The plurality of child units transmit their own moving quantity data measured by moving quantity-measuring means together with their own identification data to the master unit through the second communication means. When the identification data judging means has judged that the identification data received from the plurality of child units are in agreement with the identification data stored in the first identification data storage means, the master unit causes the estimated catch-up time calculation means to calculate an estimated catch-up time based upon the moving quantity data from the plurality of child units received through the first communication means, and notifies the estimated catch-up time through the notifying means.

Here, the difference-of-speed calculation means may include section distance calculation means for calculating the moving distances of the plurality of child units at predetermined reception intervals based upon the moving quantity data received at predetermined reception intervals, moving speed calculation means for calculating the moving speeds of the plurality of child units by dividing, by the predetermined reception intervals, the moving distances of the plurality of child units calculated by the section distance calculation means, and difference-of-speed-among-child-units calculation means for calculating differences in the moving speed among the plurality of child units.

It is further allowable that the first communication means and the second communication means are so constituted as to communicate with each other in both directions, the master unit includes reception judging means which judges whether the moving quantity data are normally received from the plurality of child units and requests the child units to send the moving quantity data again when the moving quantity data are not normally received from the child units, and the child units include control means for sending the moving quantity data again in response to the request for sending the data again.

Further, the master unit may have an electronic wrist watch function.

According to the invention, further, there is provided a body-mounted electronic device comprising communication means for executing radio communication with a plurality of child units, identification data storage means for storing identification data of the plurality of child units, identification data judging means for judging whether the identification data received from the plurality of child units are in agreement with the identification data of child units stored in the identification data storage means, distance calculation means for calculating distances among the plurality of child units from moving quantity data received from the plurality of child units, and notifying means for notifying the distances among the child units, wherein when the identification data judging means has judged that the identification data received from the plurality of child units are in agreement with the identification data stored in the identification data storage means, the distance calculation means calculates the distances among the child units based upon the moving quantity data from the plurality of child units received by the notifying means, and notifies the distances among the child units through the notifying means.

When the identification data judging means has judged that the identification data received from the plurality of child units are in agreement with the identification data stored in the identification data storage means, the distance calculation means calculates the distances among the child units based upon the moving quantity data from the plurality of child units received by the notifying means, and notifies the distances among the child units through the notifying means.

Here, the distance calculation means may include moving distance calculation means for calculating absolute distances which are the moving distances of the plurality of child units from the start positions, and among-the-child-units-distance calculation means for calculating the distances among the child units from the differences in the absolute distances of the plurality of child units calculated by the moving distance calculation means.

It is further allowable to provide distance comparator means for comparing a predetermined reference distance with the distances among the child units, and when the distance comparator means has detected the distances among the child units that are smaller than the reference distance, the notifying means notifies this fact.

It is further allowable to provide operation means for setting the reference distance and reference distance storage means for storing the reference distance set by the operation means, and when the distance comparator means has detected that the distances among the child units are in agreement with the reference distance, the notifying means notifies this fact.

Further, the reference distance is constituted by a first reference distance and a second reference distance, the distance comparator means produces a first notice signal when the distances among the child units become smaller than the first reference distance, produces a second notice signal when the distances among the child units become smaller than the second reference distance, and the notifying means notifies this fact in different modes in response to the first and second notice signals.

It is further allowable to provide difference-of-speed calculation means for calculating differences in the speed among the plurality of child units, and estimated catch-up time calculation means for calculating an estimated catch-up time until any child unit catches up another child unit based upon the distances among the child units and the difference of speed among the child units, and the estimated catch-up time may be notified by the notifying means.

According to the invention, there is further provided a body-mounted electronic device comprising communication means for executing radio communication with the plurality of child units, identification data storage means for storing identification data of the plurality of child units, identification data judging means for judging whether the identification data received from the plurality of child units are in agreement with the identification data of child units stored in the identification data storage means, difference-of-speed calculation means for calculating differences in the speed among the plurality of child units based on the moving quantity data received from the plurality of child units, estimated catch-up time calculation means for calculating an estimated catch-up time until any child unit catches up another child unit based upon the distances among the child units and the difference of speed among the child units, and notifying means for notifying the estimated catch-up time, wherein when the identification data judging means has judged that the identification data received from the plurality of child units are in agreement with the identification data stored in the identification data storage means, the master unit causes the estimated catch-up time calculation means to calculate the estimated catch-up time based upon the moving quantity data from the plurality of child units received through the communication means, and notifies the estimated catch-up time through the notifying means.

When the identification data judging means has judged that the identification data received from the plurality of child units are in agreement with the identification data stored in the identification data storage means, the master unit causes the estimated catch-up time calculation means to calculate the estimated catch-up time based upon the moving quantity data from the plurality of child units received through the communication means, and notifies the estimated catch-up time through the notifying means.

Here, the difference-of-speed calculation means may include section distance calculation means for calculating the moving distances of the plurality of child units at predetermined reception intervals based upon the moving quantity data received at predetermined reception intervals, moving speed calculation means for calculating the moving speeds of the plurality of child units by dividing, by the predetermined reception intervals, the moving distances of the plurality of child units calculated by the section distance calculation means, and difference-of-speed-among-child-units calculation means for calculating differences in the moving speed among the plurality of child units.

It is further allowable that the communication means is so constituted as to execute the communication in two directions, and provision is made of reception judging means which judges whether the moving quantity data are normally received from the child units and requests the child units to send the moving quantity data again when the moving quantity data are not normally received from the child units.

DETAILED DESCRIPTION OF THE PREFERRED EMBODIMENT

Figure 1:
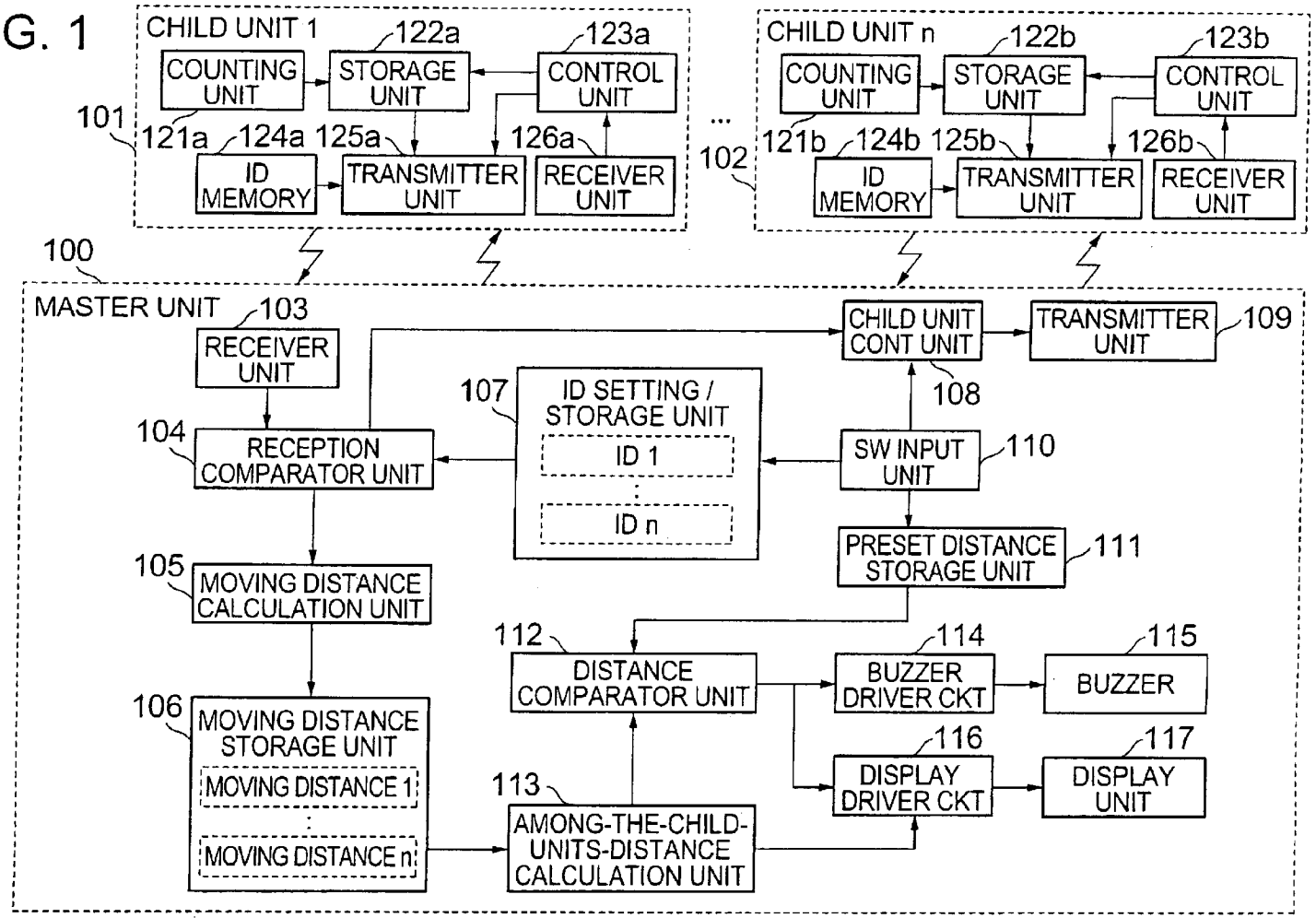
FIG. 1 is a block diagram illustrating a body-mounted electronic device system according to a first embodiment of the invention.

FIG. 1 is a block diagram of a body-mounted electronic device system according to a first embodiment of the invention.

In FIG. 1, the body-mounted electronic device system includes a master unit 100 and a plurality of child units 101, 102.

Figure 6:
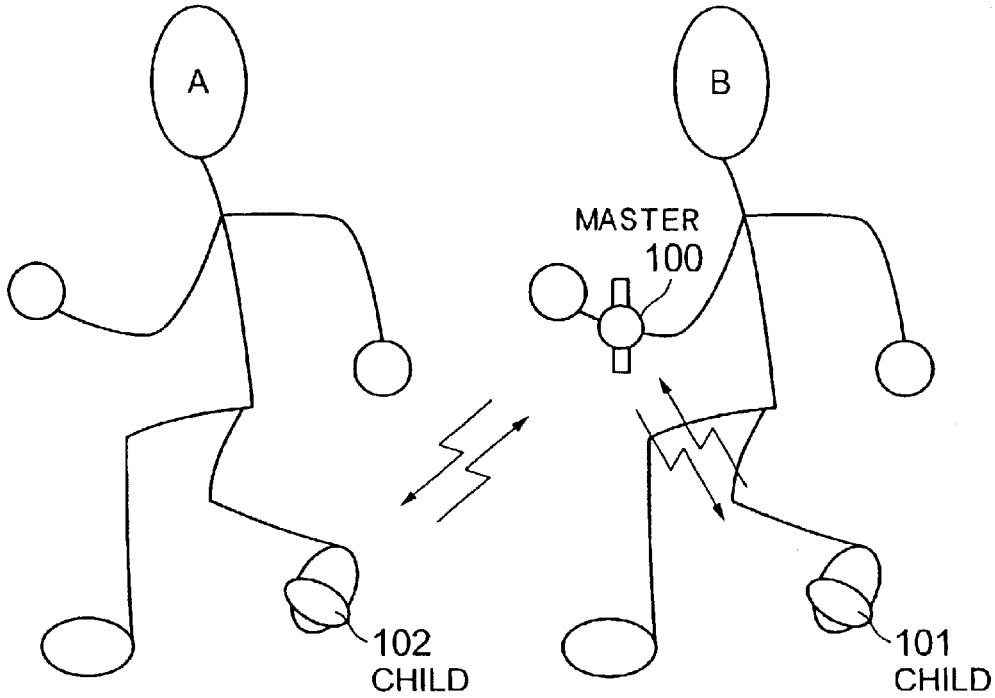
FIG. 6 is a diagram illustrating a state of using the body-mounted electronic device system according to the first embodiment of the invention.

Referring to FIG. 6 illustrating the state of using the body-mounted electronic device system, the master unit 100 and the child unit 101 are used being mounted on the body of a user (marathon runner in this embodiment) B, and the child unit 102 is used being mounted on the body of a user (marathon runner in this embodiment) A. The master unit and the child units 101, 102 are constituting body-mounted electronic devices, and the bidirectional communication is executed between the master unit 100 and the child units 101, 102.

Reverting to FIG. 1, the master unit 100 includes a receiver unit 103 for receiving signals from the plurality of child units 101, 102, a switch input unit 110 for receiving identification data (ID) of the child units 101, 102 and strides of the persons mounting the child units 101, 102, an ID setting/storage unit 107 having storage regions (ID1 to IDn) for the plurality of child units and for storing the identification data of the plurality of child units and the strides of the persons mounting the child units having identification data in the storage regions in a corresponded manner, a reception comparator unit 104 which compares the identification data received from the child units 101, 102 with the identification data stored in the ID setting/storage unit 107 and judges whether the received signals are those from the normal child units, a moving distance calculation unit 105 for calculating the moving distances of the child units 101, 102, a moving distance storage unit 106 having a plurality of moving distance storage regions (moving distance 1 to moving distance n) and for storing the moving distances of the child units 101, 102 calculated by the moving distance calculation unit 105 in the storage regions, an among-the-child-units-distance calculation unit 113 for calculating the distances among the child units 101 and 102 (spaced-apart distances) based on the moving distances of the child units 101, 102 stored in the moving distance storage unit 106, a preset distance storage unit 111 for storing a predetermined distance (reference distance) set by a switch input unit 110, a distance comparator unit 112 which compares the distances among the child units calculated by the among-the-child-units-distance calculation unit 113 with the reference distance stored in the preset distance storage unit 111 and produces a signal depending upon the result of comparison, a buzzer driver circuit 114 for driving a buzzer 115 in response to a signal from the distance comparator unit 112, the buzzer 115 driven by the buzzer driver circuit 114 to produce a notice sound, a display driver circuit 116 for driving a display unit 117 in response to a signal from the distance comparator unit 112, the display unit 117 driven by the display driver circuit 116 to display the notice, a child unit control unit 108 that generates a child unit control signal for controlling the child units 101, 102 depending upon the operation of the switch unit 110 and in response to the signal from the reception comparator unit 104, and a transmitter unit 109 for transmitting signals to the child units 101, 102.

The child units 101, 102 include counting units 121*a*, 121*b* for counting the moving amounts (numbers of steps in this embodiment) corresponding to the moving distances of the runners B and A mounting the child units 101 and 102, storage units 122*a*, 122*b* for storing the moving quantities counted by the counting units 121*a*, 121*b*, control units 123*a*, 123*b* for controlling the whole child units 101, 102, ID memories 124*a*, 124*b* for storing their own identification data, transmitter units 125*a*, 125*b* for transmitting signals to the master unit 100, and receiver units 126*a*, 126*b* for receiving signals from the master unit 100.

Here, the receiver unit 103 and the transmitter unit 109 constitute first communication means, the reception comparator unit 104 constitutes identification data judging means, the moving distance calculation unit 105 constitutes moving distance calculation means and section distance calculation means, the moving distance storage unit 106 constitutes moving distance storage means, the ID setting/storage unit 107 constitutes first identification data storage means, the distance comparator unit 112 constitutes distance comparator means, the among-the-child-units-distance calculation unit 113 constitutes among-the-child-units-distance calculation means, the switch input unit 110 constitutes operation means, and the preset distance storage unit 111 constitutes reference distance storage means.

The buzzer driver circuit 114, buzzer 15, display driver circuit 116 and display unit 117 constitute notifying means. Further, the buzzer driver circuit 114 and buzzer 115 constitute sound notifying means, and the display driver circuit 116 and display unit 117 constitute display notifying means.

The moving distance calculation unit 105, moving distance storage unit 106 and among-the-child-units-distance calculation unit 113 constitute distance calculation means, and the reception comparator unit 104 and the child unit control unit 108 constitute reception judging means.

Further, the counting units 121*a* and 121*b* constitute moving quantity counting means, the storage units 122*a* and 122*b* constitute moving quantity storage means, the control units 123*a* and 123*b* constitute control means, the ID memories 124*a* and 124*b* constitute second identification data storage means, and the transmitter units 125*a*, 125*b* and the receiver units 126*a*, 126*b* constitute second communication means.

Figure 2:
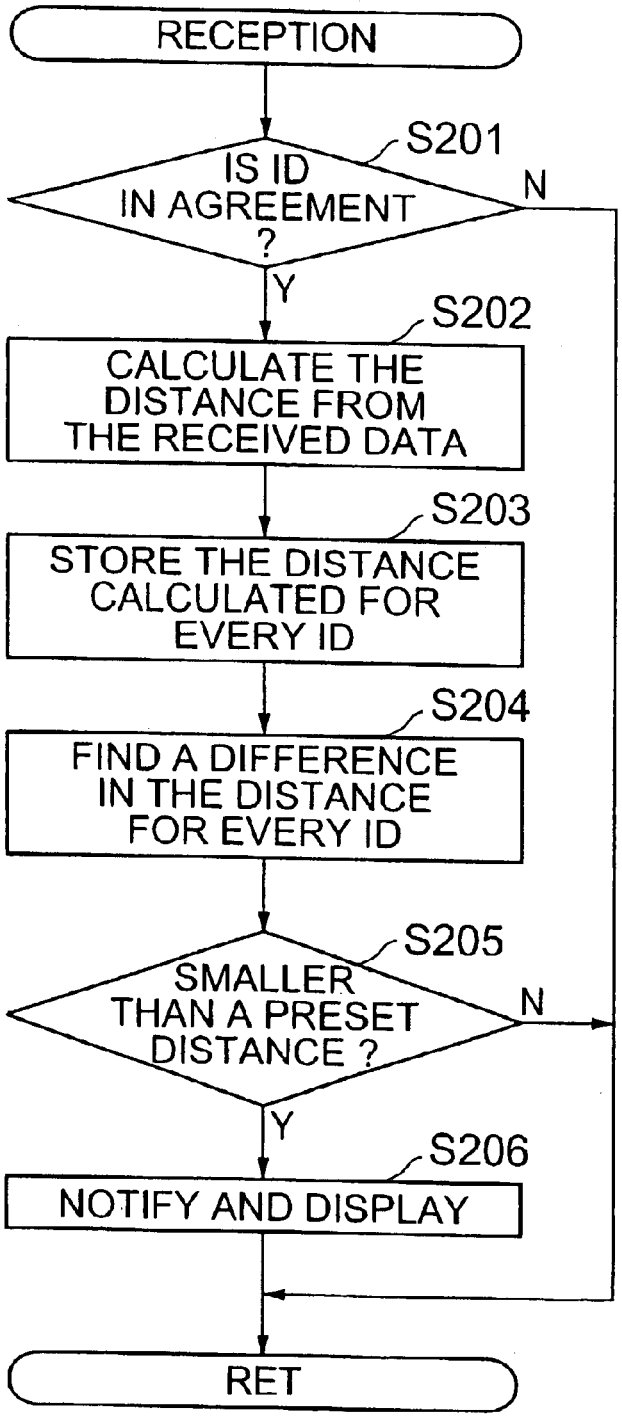
FIG. 2 is a flowchart illustrating the processing of the body-mounted electronic device system according to the first embodiment of the invention.

FIG. 2 is a flowchart illustrating the processing of the body-mounted electronic device system according to a first embodiment, i.e., illustrating the processing of the master unit 100.

Figure 3:
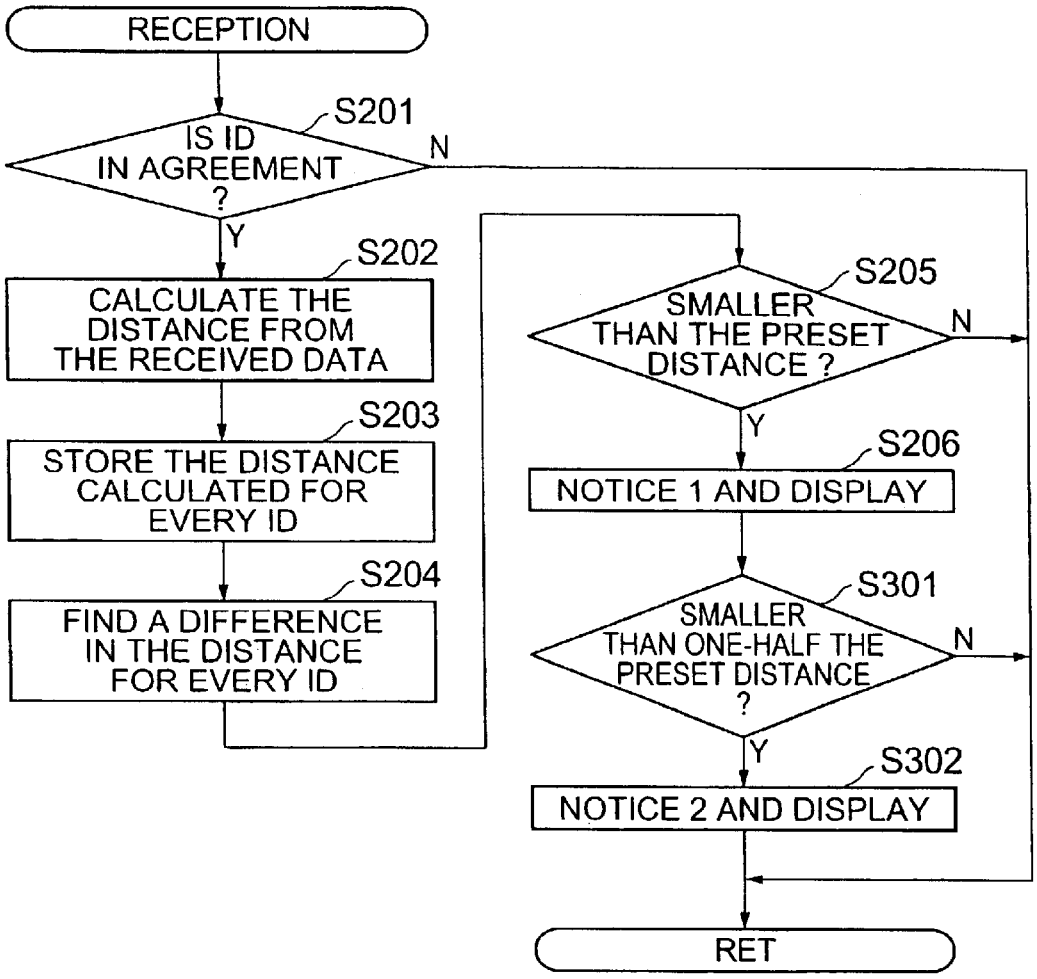
FIG. 3 is a flowchart illustrating the processing of the body-mounted electronic device system according to the first embodiment of the invention.

FIG. 3 is a flowchart illustrating the processing of the body-mounted electronic device system according to the first embodiment and in which the processing of FIG. 2 is combined with an additional processing, i.e., illustrating the processing of the master unit 100.

Figure 4:
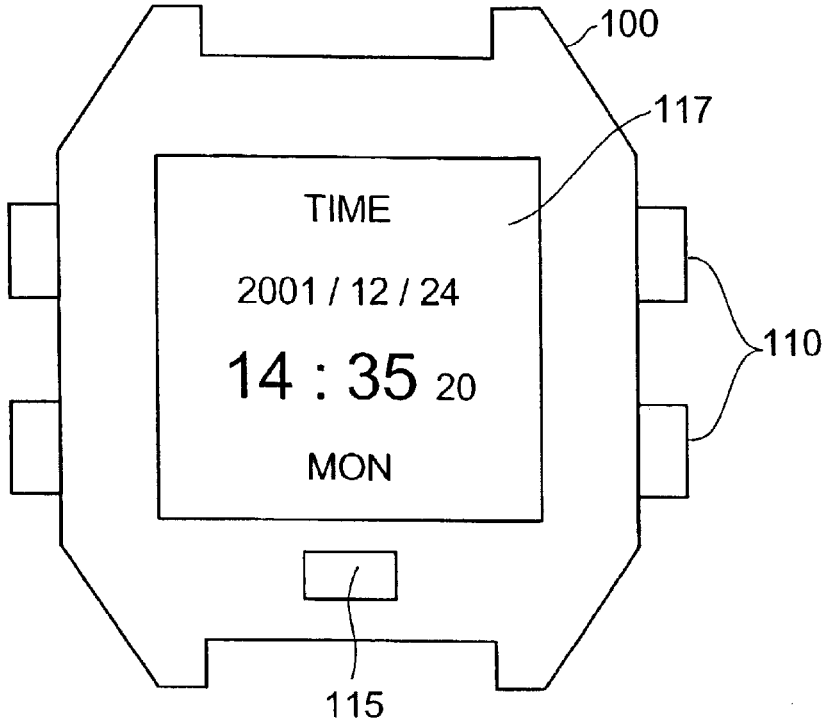
FIG. 4 is a view illustrating the appearance of a master unit according to the first embodiment of the invention.

FIG. 4 is a view illustrating the appearance of the master unit 100, and in which the same portions as those of FIG. 1 are denoted by the same reference numerals. The master unit 100 is constituted by an electronic wrist watch which is used being mounted on, an arm, the electronic wrist watch having an additional processing function that will be described later. FIG. 4 is a view of a state of displaying the time. In FIG. 4, there are provided the switch input unit 110 constituting operation means, the buzzer 115 constituting notifying means and the display unit 117 on the outer part of the master unit 100.

Figure 5:
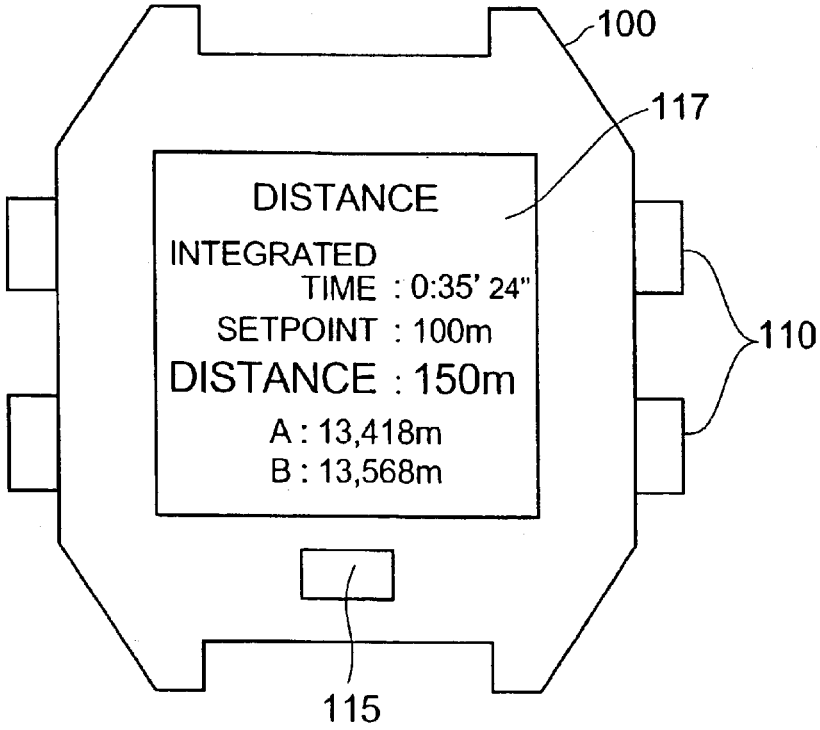
FIG. 5 is a view illustrating the appearance of the master unit according to the first embodiment of the invention.

FIG. 5 is a view illustrating the content displayed on the display unit 117 of the master unit at the time when a processing that will be described later is executed, and wherein the same portions as those of FIG. 1 are denoted by the same reference numerals.

The thus constituted body-mounted electronic device system according to the first embodiment will now be described in detail with reference to FIGS. 1 to 6.

The child units 101 and 102 operate in the same manner. Therefore, the operation of the child unit 101 is mainly described and the operation of the child unit 102 is described as required. Identification data specific to the child units have been stored in the ID memories 124*a* and 124*b*. It is, here, presumed that the identification data of the child units 101 and 102 have been stored in the ID setting/storage unit 107 by operating the switch input unit 110. The identification data may be stored in the ID setting/storage unit 107 by transmitting the identification data from the child units 101, 102 to the master unit 100 in a wireless manner, and storing the identification data of the child units 101, 102 received by the master unit 100 in the ID setting/storage unit 107.

It is further presumed that the strides of persons (runners) mounting the child units having identification data are stored in the ID setting/storage unit 107 through the switch input unit 110 being corresponded to the identification data of the child units.

It is presumed that the preset distance storage unit 111 stores the reference distance through the switch input unit 110 to notify that the distance between the child units 101 and 102 is becoming smaller than a predetermined distance (reference distance). Further, the preset distance may have been stored and may be overwritten by using the switch input unit 110.

Though not shown, the switch input unit 110 is so operated as to initialize the moving distance storage unit 106. In response to the initialization operation of the switch input unit 110, the child control unit 108 transmits the initialization signal to all child units 101, 102 through the transmitter unit 109. The child units 101 and 102 receive the initialization signal through the receiver units 126*a*, 126*b*, and the control units 123*a* and 123*b* initialize the storage units 122*a* and 122*b*.

To use the body-mounted electronic devices 100 to 102, first, the master unit 100 is mounted on the wrist of the runner B and the child unit 101 is mounted on the ankle of the runner B as shown in FIG. 6. The child unit 102 is mounted on the ankle of the runner A.

In this state, the switch input unit 110 is started. This initializes the timer (not shown) possessed by the master unit 100 as a time keeping function, and the time is counted by the timer starting from zero. At the same time, the switch input unit 110 is started so that a start signal is transmitted to the child units 101 and 102 from the child control unit 108 through the transmitter unit.

The child unit 101 receives the start signal through the receiver unit 126*a*, and the control unit 123*a* starts counting the number of steps of the runner B through the counting unit 121*a*. The number of steps counted by the counting unit 121*a* is stored in the storage unit 122*a*. Every after the passage of a predetermine period of time, the control unit 123*a* reads the step number data stored in the storage unit 122*a* within the predetermined period of time and sends the data to the transmitter unit 125*a*. The transmitter unit 125*a* transmits the step number data in a wireless manner together with the identification data of the child unit 101 stored in the ID memory 124*a*. Then, the child unit 101 transmits to the master unit 100 the data related to the number of steps traveled by the runner B within the predetermined period of time.

Upon receiving the step number data and the identification data through the receiver unit 103, the reception comparator unit 104 in the master unit 100 judges whether the received identification data is in agreement with any of the identification data stored in the ID setting/storage unit 107 (step S201 in FIG. 2). When the identification data are not in agreement, the processing ends.

When the received identification data are in agreement with the identification data stored in the ID setting/storage unit 107 at step S201, the moving distance calculation unit 105 calculates the moving distance from the received step number data (step S202). The moving distance is calculated by multiplying the number of steps by the stride stored in the ID setting unit 107 being corresponded to the identification data. Thus, the moving distance of the runner B within the predetermined period of time is calculated.

The moving distance calculation unit 105 adds up together the moving distance calculated above and the cumulative moving distance (absolute moving distance) from the start position stored in the moving distance storage unit 106 being corresponded to the identification data, and stores the added result in the moving distance storage unit 106 (step S203). In the moving distance storage unit 106 is stored, at any time, the absolute moving distance accumulated from the start position.

The same operation is conducted for the child unit 102, too, and the absolute moving distance of the runner A is stored in the moving distance storage unit 106 being corresponded to the identification data of the child unit 102.

Next, the among-the-child-units-distance calculation unit 113 calculates the distance (spaced-apart distance) between the child unit 101 and the child unit 102 (step S204).

The integrated time data from the starting time counted by the timer, the reference distance data stored in the preset distance storage unit 111, the moving distance data of the runners A and B stored in the moving distance storage unit 105 and the distance data between the child units, are input to the display driver circuit 116, and the display unit 117 displays the above data as shown in FIG. 5.

After step S204, the distance comparator unit 112 compares the distance between the child units with the first reference distance set to the preset distance storage unit 111, and judges whether the spaced-apart distance is smaller than the reference distance (step S205). When it is judged that the spaced-apart distance is smaller than the reference distance, the distance comparator unit 112 sends a first notice signal to the buzzer driver circuit 114 and to the display driver circuit 116. The buzzer driver circuit 114 drives the buzzer 115 in response to the first notice signal, and the buzzer 115 produces a first notice sound to notify that the distance between the runner A and the runner B is becoming smaller than the reference distance. The notice sound may be, for example, the generation of sound maintaining a predetermined period.

The display driver circuit 116 drives the display unit 117 in response to the first notice signal, and the display unit 117 displays a first notice to notify that the distance between the runner A and the runner B is becoming smaller than the reference distance (step S206). As the display of notice, for example, the display unit 117 as a whole may be flashed in a predetermined color in a state where the data are displayed as shown in FIG. 5.

By repeating the above processing, the child units 101 and 102 transmit to the master unit 100 the step number data of the runners B and A every after the passage of a predetermined period of time, the absolute moving distances of the child units 101 and 102 are stored in the moving distance storage unit 106 of the master unit 100, and the display unit 117 offers the display of FIG. 5. Further, the notice is displayed when the spaced-apart distance between the child units 101 and 102 becomes smaller than the first reference distance.

Referring to FIG. 3, the following processing may be executed following step S206.

That is, in FIG. 3, after the processing (steps S201 to S206) of FIG. 2 is executed, it is judged if the distance between the child unit 101 and the child unit 102 is smaller than the second reference distance which is one-half the first reference distance (step S301).

When it is judged at step S301 that the distance between the child units is smaller than the second reference distance, a second notice signal is sent to the buzzer driver circuit 114 and to the display driver circuit 116. The buzzer driver circuit 114 drives the buzzer 115 in response to the second notice signal, and the buzzer 115 produces the second notice sound to notify that the distance between the runner A and the runner B is becoming smaller than the second reference distance. Further, the display driver circuit 116 drives the display unit 117 in response to the second notice signal, and the display unit 117 displays the second notice to notify that the distance between the runner A and the runner B is becoming smaller than the second reference distance (step S302). The second notice sound and the display of the second notice may be those of modes different from the first notice sound and the display of the first notice. It would be more effective if the second notice sound and the display of the second notice are in more impending modes than those of the first notice sound and the display of the first notice.

Next, described below is the operation of the case where the data are normally received by the master unit 100 from the child unit 102 but the data related to the number of steps are not normally received by the master unit 100 from the child unit 101, like when the data transmission timings are overlapped between the child unit 101 and the child unit 102. Here, described below is the case where the identification data of the child unit 101 are normally received by the master unit 100 but the step number data are not normally received.

In this case, the identification data transmitted from the child unit 101 are identified by the reception comparator unit 104. The reception comparator unit 104 detects the transmission of data from the child unit 101, detects that the step number data have not been normally received, and causes the child unit control unit 108 to request the child unit 101 to transmit the data again. Upon receipt of the request for transmitting the data again, the child control unit 108 transmits a signal in a wireless manner through the transmitter unit 109 to request again the transmission of data representing the child unit 101 and the data for instructing the transmission of data again.

The child unit 101 receives the transmission-request signal again through the receiver unit 126*a*, identifies the identification data in the transmission-request signal again through the control unit 123*a*, and judges that the transmission-request signal is the one addressed to the child unit 101 itself. The control unit 123*a* transmits, through the transmission unit 125*a*, the step number data stored in the storage unit 122*a* and transmitted in the previous time together with its own identification data. The master unit 100 receives the identification data and the step number data from the child unit 101, and executes the above-mentioned processing. The processing for transmitting the data again is continued until the step number data are normally received by the master unit 100 from the child unit 101.

Conversely, even when the data transmission timings are overlapped between the child unit 101 and the child unit 102, and the data from the child unit 101 are normally received by the master unit 100 but the step number data transmitted from the child unit 102 are not normally received by the master unit 100, too, the operation same as the one described above is executed by the child unit 102. This makes it possible to reliably communicate the data between the master unit 100 and the child units 101, 102.

In order to prevent the data transmission timings from overlapping between the child unit 101 and the child unit 102, the data transmission timings may have been deviated between the child units 101 and 102. When the data transmission timings are frequently overlapped, however, the switch input unit 110 may be operated to change the data transmission timings of the child units 101 and 102.

That is, when the identification data of the child unit (e.g., child unit 101) for changing the transmission timing and the data for changing the transmission timing representing a new transmission timing are input through the switch operation unit 110, the child unit control unit 108 transmits the identification data and a signal for requesting the change of transmission timing inclusive of transmission timing change data in a wireless manner through the transmitter unit 109.

The child units 101 and 102 judge the identification data in the signal for requesting the change of transmission timing received through the receiver units 126*a*, 126*b*, and determines whether the signal is the one requesting the change of transmission timing addressed to themselves.

In this embodiment, the signal is the one requesting a change in the transmission timing and addressed to the child unit 101. Therefore, the control unit 123*a* in the child unit 101 judges the identification data in the received signal requesting a change in the transmission timing, and determines that the request for changing the transmission timing is the one addressed to the child unit 101. The control unit 123*a* changes the data transmission timing into the one corresponding to the received data for changing the transmission timing.

It is, then, allowed to prevent the data transmission timings from overlapping between the child units 101 and 102.

In the child unit 102, the control unit 123*b* judges the identification data in the signal requesting a change in the transmission timing received through the receiver unit 126*b*, determines that the request for changing the transmission timing is not addressed to the child unit 102, and does not execute the processing for changing the transmission timing. To change the transmission timing of the child unit 102, the master unit 100 transmits a signal requesting a change in the transmission timing inclusive of the identification data of the child unit 102.

Figure 7:
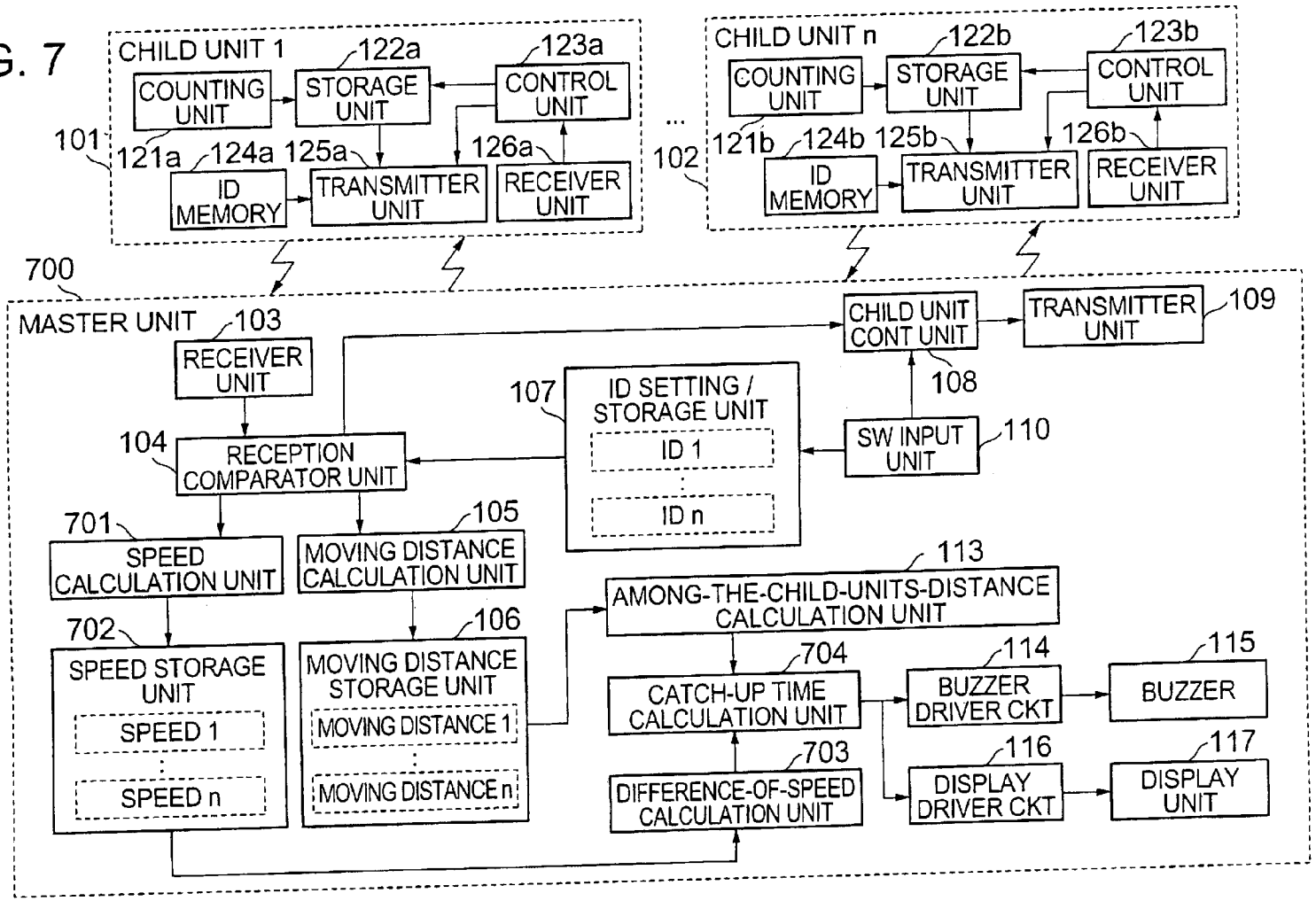
FIG. 7 is a block diagram illustrating the body-mounted electronic device system according to a second embodiment of the invention.

FIG. 7 is a block diagram of the body-mounted electronic device system according to a second embodiment of the invention, and the portions having the same functions as those of FIG. 1 are denoted by the same reference numerals.

Principal differences between the second embodiment and the first embodiment are that the master unit 700 includes a speed calculation unit 701 for calculating the speeds of the child units 101 and 102, a speed storage unit 702 for storing the speeds of the child units 101 and 102 calculated by the speed calculation unit 701, a difference-of-speed calculation unit 703 for calculating a difference of speed between the child units 101 and 102, and a catch-up time calculation unit 704 for calculating an estimated catch-up time which is an estimated time until the child units 101, 102 catch up other child units 102, 101, and that the estimated catch-up time is notified by the buzzer 115 and by the display unit 117.

Here, the calculation unit 701 constitutes moving speed calculation means, the difference-of-speed calculation unit 703 constitutes among-the-child-units-speed calculation means, and the catch-up time calculation unit 704 constitutes estimated catch-up time calculation means. Further, the moving distance calculation unit 105, speed calculation unit 701, speed storage unit 702 and difference-of-speed calculation unit 703 constitute difference-of-speed calculation means.

Figure 8:
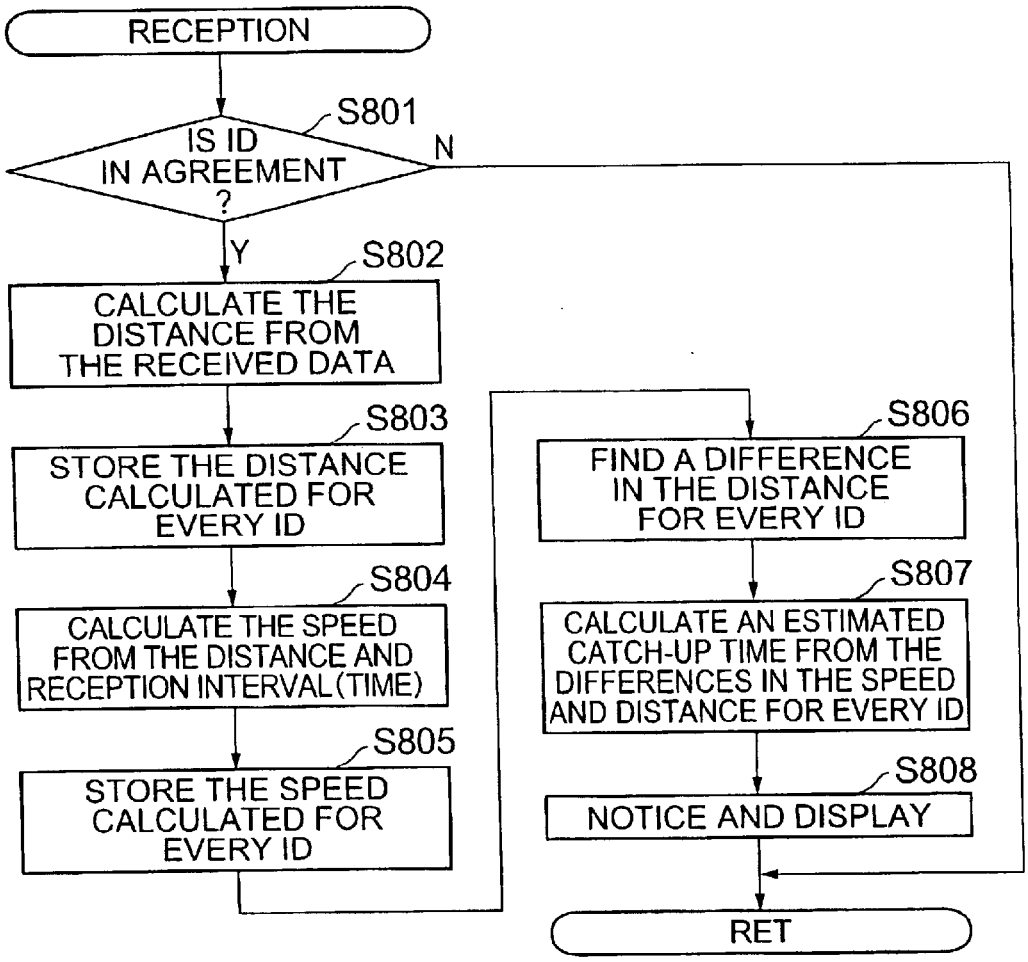
FIG. 8 is a flowchart illustrating the processing of the body-mounted electronic device system according to the second embodiment of the invention.

FIG. 8 is a flowchart illustrating the processing of the body-mounted electronic device system according to the second embodiment, i.e., illustrating the processing of the master unit 700.

Figure 9:
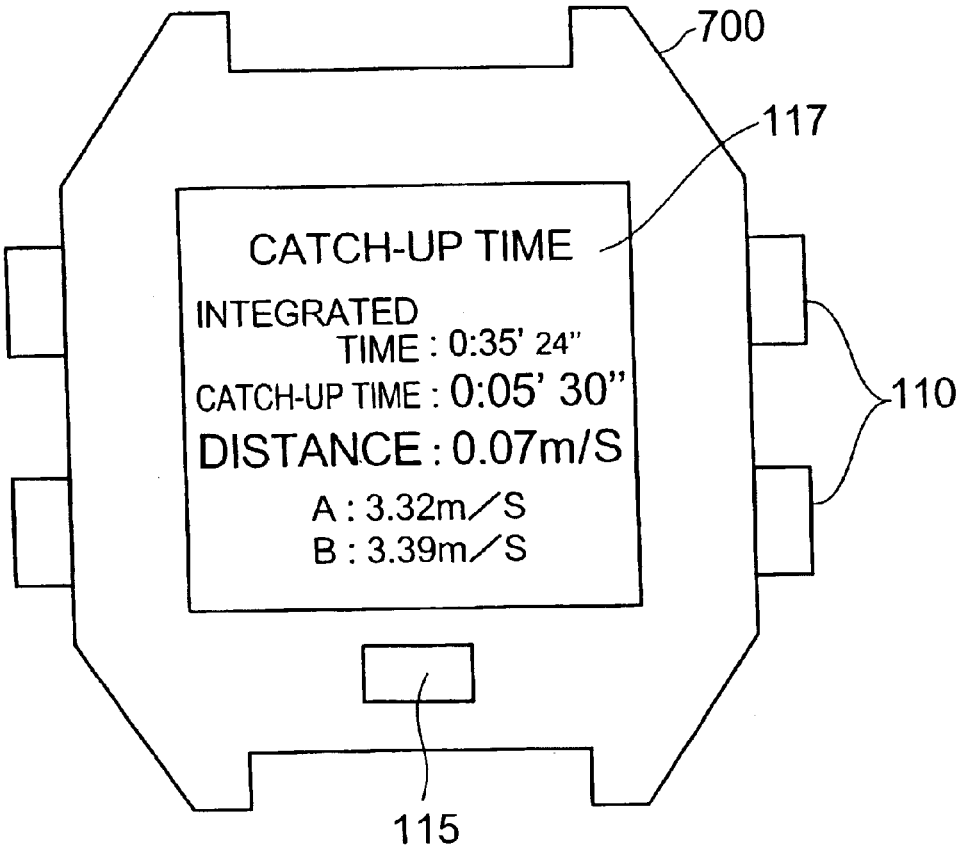
FIG. 9 is a view illustrating the appearance of the master unit according to the second embodiment of the invention.
Figure 10:
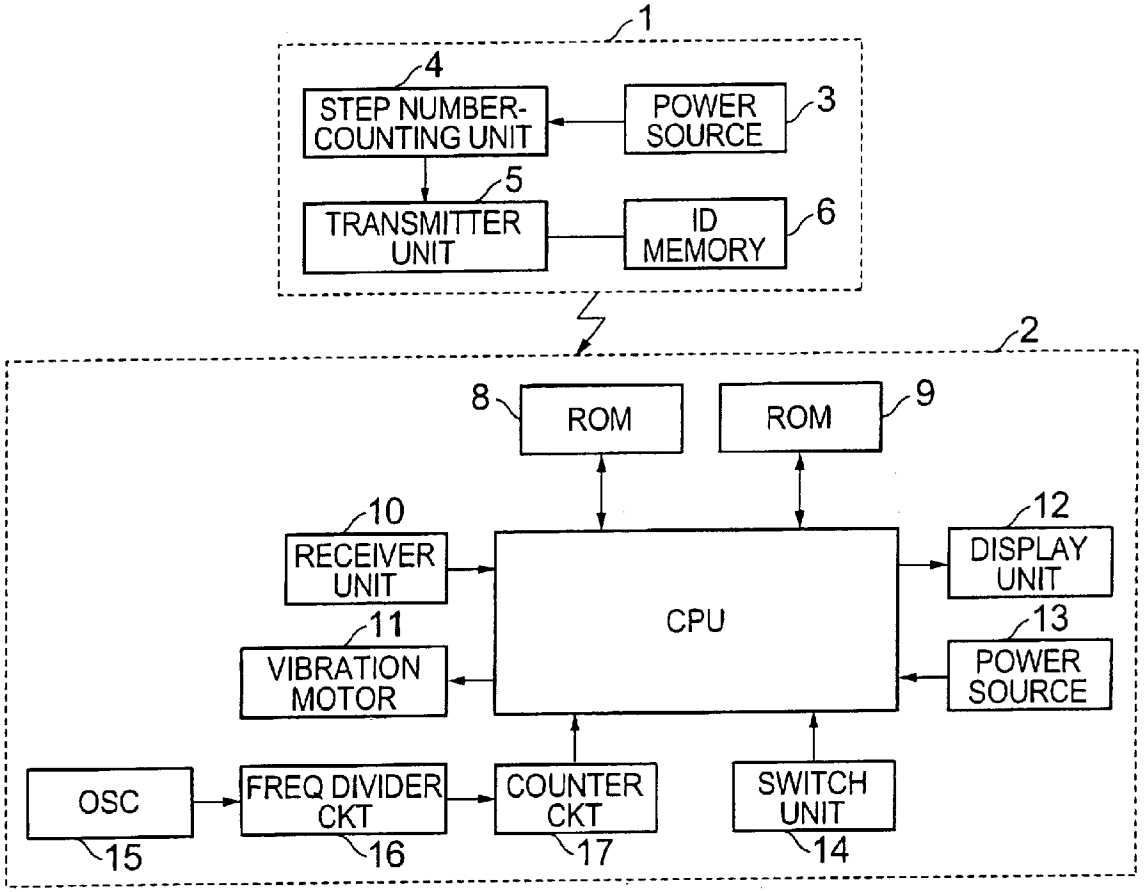
FIG. 10 is a block diagram illustrating a conventional body-mounted electronic device system.

FIG. 9 is a view illustrating the appearance of the master unit 700, and in which the same portions as those of FIG. 7 are denoted by the same reference numerals. The master unit 700 is constituted by an electronic wrist watch which is used being mounted on an arm, the electronic wrist watch having an additional processing function that will be described later.

The thus constituted body-mounted electronic device system according to the second embodiment will now be described chiefly with respect to the differences from the first embodiment.

Here, the child units 101 and 102 operate in the same manner. Therefore, the operation of the child unit 101 is mainly described. Identification data specific to the child units have been stored in the ID memories 124*a* and 124*b* in the same manner as that of the first embodiment. It is further presumed that the identification data of the child units 101, 102 and the strides of the runners mounting the child units 101, 102 having identification data are stored in the ID setting/storage unit 107 being corresponded to the identification data of the child units 101 and 102. It is further presumed that the moving distance storage unit 106, speed storage unit 702, and the storage units 122*a* and 122*b* have been initialized.

To use the body-mounted electronic devices 101, 102 and 700, the master unit 700 is mounted on the wrist of the runner B and the child unit 101 is mounted on the ankle of the runner B in the same manner as the one shown in FIG. 6. The child unit 102 is mounted on the ankle of the runner A.

In this state, the switch input unit 110 is operated. This initializes the timer (not shown) possessed by the master unit 100 as a timekeeping function, and the time is counted by the timer starting from zero. At the same time, the switch input unit 110 is operated so that a start signal is transmitted to the child units 101 and 102 from the child control unit 108 through the transmitter unit.

The child unit 101 receives the start signal through the receiver unit 126*a*, and the control unit 123*a* starts counting the number of steps of the runner B through the counting unit 121*a*. The number of steps counted by the counting unit 121*a* is stored in the storage unit 122*a*. Every after the passage of a predetermine period of time, the control unit 123*a* reads the step number data stored in the storage unit 122*a* within the predetermined period of time and sends the data to the transmitter unit 125*a*. The transmitter unit 125*a* transmits the step number data in a wireless manner together with the identification data of the child unit 101 stored in the ID memory 124*a*. Then, the child unit 101 transmits to the master unit 100 the data related to the number of steps traveled by the runner B within the predetermined period of time.

Upon receiving the step number data and the identification data through the receiver unit 103, the reception comparator unit 104 in the master unit 700 judges whether the received identification data is in agreement with any of the identification data stored in the ID setting/storage unit 107 (step S801 in FIG. 8). When the identification data are not in agreement, the processing ends.

When it is judged at step S801 that the received identification data is in agreement with the identification data stored in the ID setting/storage unit 107, the moving distance calculation unit 105 calculates the moving distance from the received step number data (step S802). The moving distance of the child unit 101 (i.e., runner B) is calculated by multiplying the number of steps by the stride of the runner B stored in the ID setting unit 107 being corresponded to the identification data. Thus, there is calculated the moving distance of the runner B during the above predetermined period.

The moving distance calculation unit 105 adds up together the moving distance calculated above and the cumulative moving distance (absolute moving distance) stored in the moving distance storage unit 106 being corresponded to the identification data, and stores the added result in the moving distance storage unit 106 (step S803). In the moving distance storage unit 106 is stored the absolute moving distance accumulated from the start position.

On the other hand, the speed calculation unit 701 calculates the speed of the child unit 101 (i.e., runner B) by dividing the moving distance during the predetermined period of time calculated by the moving distance calculation unit 105, by the data reception interval from the child unit 101 counted by a timer (not shown) in the master unit 700 (step S804), and stores the calculated speed of the child unit 101 in the speed storage unit 702 (step S805).

The same operation is conducted for the child unit 102, too, and the absolute moving distance of the child unit 102 (i.e., runner A) is stored in the moving distance storage unit 106 (steps S802, S803). Further, the speed calculation unit 701 calculates the speed of the child unit 102 by dividing the moving distance during the predetermined period of time calculated by the moving distance calculation unit 105, by the data reception interval (corresponding to the above predetermined period of time) from the child unit 102 counted by the timer (not shown) in the master unit 700 (step S804), and stores the calculated speed of the child unit 102 in the speed storage unit 702 (step S805).

Next, the among-the-child-units-distance calculation unit 113 calculates the distance (spaced-apart distance) between the child unit 101 and the child unit 102 (step S806).

Then, the difference-of-speed calculation unit 703 calculates a difference in the speed between the child unit 101 and the child unit 102, and the catch-up time calculation unit 704 calculates an estimated time in which the child unit 101 catches up the child unit 102, i.e., calculates the estimated catch-up time in which it is expected that the runner B catches up the runner A by dividing the spaced-apart distance by the difference in the speed (step S807). FIG. 6 shows a case where it is presumed that the runner A is leading followed by the runner B. When the runner B leads and the runner A follows, however, the estimated catch-up time is the one in which the runner B is caught by the runner A.

The integrated time data from the start point counted by the timer, the estimated catch-up time data, the data related to the difference in the speed between the child units 101 and 102, and the speed data of the runners A and B representing the speeds of the child units 102 and 101, are input to the display driver circuit 116. The display unit 117, then, displays various data as shown in FIG. 9. Further, the estimated catch-up time data is input to the buzzer driver circuit 114, and the estimated catch-up time is notified from the buzzer 115.

By repeating the above processing, the step number data of the runners B and A are transmitted from the child units 101 and 102 to the master unit 100 for every predetermined period of time, the absolute moving distances of the child units 101 and 102 are stored in the moving distance storage unit 106 in the master unit 100, the speeds of the child units 101 and 102 are stored in the speed storage unit 702, the display unit 117 offers the display as shown in FIG. 9, and the buzzer 115 notifies the estimated catch-up time.

Here, in case the data transmission timings of the child units 101 and 102 are overlapped one upon the other, the processing is executed in the same manner as that of the above first embodiment.

As described above, a body-mounted electronic device system according to this embodiment includes a master unit 100 and a plurality of child units 101, 102 that can be mounted on the bodies, wherein the master unit 100 comprises first communication means 103, 109 for executing radio communication with the plurality of child units 101 and 102, first identification data storage means 107 for storing identification data of the plurality of child units 101 and 102, identification data judging means 104 for judging whether the identification data received from the plurality of child units 101 and 102 are in agreement with the identification data of child units stored in the first identification data storage means 107, distance calculation means 105, 106, 113 for calculating distances among the plurality of child units 101, 102 from moving quantity data received from the plurality of child units 101 and 102, and notifying means 114 to 117 for notifying the distances among the child units, each of the plurality of child units 101, 102 comprises second communication means 125*a*, 125*b* for executing radio communication with the master unit 100, moving quantity-measuring means 121*a*, 121*b* for measuring the moving quantity corresponding to its own moving distance, and second identification data storage means 124*a*, 124*b* for storing its own identification data, each of the plurality of child units 101, 102 transmits its own moving quantity data measured by the moving quantity-measuring means 121*a*, 121*b* together with its own identification data to the master unit 100 through the second communication means 125*a*, 125*b*, and when the identification data judging means 104 has judged that the identification data received from the plurality of child units 101, 102 are in agreement with the identification data stored in the first identification data storage means 107, the master unit 100 causes the distance calculation means 105, 106, 113 to calculate the distances among the child units 101, 102 based upon the moving quantity data from the plurality of child units 101, 102 received through the first communication means 103, 109, and notifies the distances among the child units 101, 102 through the notifying means 114 to 117.

Here, provision is made of distance comparator means 112 for comparing the predetermined reference distance with the distances among the child units 101, 102, and when the distance comparator means 112 has detected the distances among the child units 101 and 102 that are smaller than the reference distance, the notifying means 114 to 117 notify this fact.

The moving quantity data represents the number of steps traveled by a person (competitor or runner) mounting the child unit, the identification data storage means 107 stores, in advance, the identification data of the child units 101, 102 and the strides of the persons mounting the child units 101, 102 being corresponded to the identification data as a result of manipulating the operation means 110, and the distance calculation means 105, 106, 113 calculate the moving distances of the child units 101, 102, i.e., calculate the moving distances the persons mounting the child units by multiplying the step number data received from the child units 101, 102 by the strides of the persons mounting the child units 101, 102.

Further, a body-mounted electronic device system according to the embodiment includes a master unit 700 and a plurality of child units 101, 102 that can be mounted on the bodies, wherein the master unit 700 comprises first communication means 103, 109 for executing radio communication with the plurality of child units 101, 102, first identification data storage means 107 for storing identification data of the plurality of child units 101, 102, identification data judging means 104 for judging whether the identification data received from the plurality of child units 101, 102 are in agreement with the identification data of child units stored in the first identification data storage means 107, difference-of-speed calculation means 105, 701 to 703 for calculating differences in the speed among the plurality of child units 101, 102 based on the moving quantity data received from the plurality of child units 101, 102, estimated catch-up time calculation means 704 for calculating an estimated catch-up time until any child unit 101 or 102 catches up another child unit 102 or 101 based upon the distances among the child units 101, 102 and the difference of speed among the child units 101, 102, and notifying means 114 to 117 for notifying the estimated catch-up time, each of the plurality of child units 101, 102 comprises second communication means 125*a*, 125*b* for executing radio communication with the master unit 700, moving quantity-measuring means 121*a*, 121*b* for measuring the moving quantity corresponding to its own moving distance, and second identification data storage means 124*a*, 124*b* for storing its own identification data, each of the plurality of child units 101, 102 transmits its own moving quantity data measured by the moving quantity-measuring means 121*a*, 121*b* together with its own identification data to the master unit 700 through the second communication means 125*a*, 125*b*, and when the identification data judging means 104 has judged that the identification data received from the plurality of child units 101, 102 are in agreement with the identification data stored in the first identification data storage means 107, the master unit 700 causes the estimated catch-up time calculation means 704 to calculate the estimated catch-up time based upon the moving quantity data from the plurality of child units 101, 102 received through the first communication means 103, 109, and notifies the estimated catch-up time through the notifying means 114 to 117.

Here, the difference-of-speed calculation means 105, 701 to 703 may include section distance calculation means 105 for calculating moving distances of the plurality of child units 101, 102 at predetermined reception intervals based upon the moving quantity data received at predetermined reception intervals, moving distance calculation means 701 for calculating moving speeds of the plurality of child units 101, 102 by dividing, by the predetermined reception intervals, the moving distances of the plurality of child units 101, 102 calculated by the section distance calculation means 105, and difference-of-speed-among-child-units calculation means 703 for calculating differences in the moving speed among the plurality of child units 101, 102.

Therefore, a plurality of child units can be shared by many persons while using one master unit.

It is further allowed to learn relationships to other competitors, such as distances, difference in the speed and estimated catch-up time for catching up the competitor.

The body-mounted electronic devices 100, 700 are constituted by electronic wrist watches which are furnished with a distance calculation function and an estimated catch-up time calculation function. Namely, the body-mounted electronic devices 100, 700 have the electronic wrist watch function, enabling their own timekeeping function to be effectively utilized yet featuring a simple constitution.

By using the body-mounted electronic devices according to this embodiment, it is allowed to build up a body-mounted electronic device system enabling a plurality of child units to be shared by many persons. It is further allowed to build up a body-mounted electronic device system which makes it possible to learn relationships to other competitors, such as spaced-apart distances, difference in the speed and estimated catch-up time for catching up the competitor.

According to the body-mounted electronic device system of this invention, it is allowed to grasp the conditions of other competitors as well as to make sure relationships between the user himself and other competitors, such as spaced-apart distances and estimated catch-up time.

By using the body-mounted electronic devices of this invention, further, it is allowed to build up a body-mounted electronic device system which makes it possible to grasp the conditions of other competitors. It is, further, allowed to build up a body-mounted electronic device system which makes it possible to make sure relationships between the user himself and other competitors, such as spaced-apart distances and estimated catch-up time.

What is claimed is:

1. A body-mounted electronic device system comprising:

a master unit mounted on the bodies having first communication means for executing radio communication with a plurality of child units, first identification data storage means for storing identification data of the plurality of child units, identification data judging means for judging whether the identification data received from the plurality of child units are in agreement with the identification data of child units stored in the first identification data storage means, distance calculation means for calculating distances among the plurality of child units from moving quantity data received from the plurality of child units, and notifying means for notifying the distances among the child units; and the plurality of child units mounted on the bodies having second communication means for executing radio communication with the master unit, moving quantity-measuring means for measuring the moving quantity corresponding to its own moving distance, and second identification data storage means for storing its own identification data, wherein each of the plurality of child units transmits its own moving quantity data measured by the moving quantity-measuring means together with its own identification data to the master unit through the second communication means, and when the identification data judging means has judged that the identification data received from the plurality of child units are in agreement with the identification data stored in the first identification data storage means, the master unit causes the distance calculation means to calculate the distances among the child units based upon the moving quantity data from the plurality of child units received through the first communication means, and notifies the distances among the child units through the notifying means.

2. A body-mounted electronic device system according to claim 1, wherein the distance calculation means includes moving distance calculation means for calculating absolute distances which are the moving distances of the plurality of child units from the start position, and among-the-child-units-distance calculation means for calculating the distances among the child units from the differences in the absolute distances of the plurality of child units calculated by the moving distance calculation means.

3. A body-mounted electronic device system according to claim 1, further comprising distance comparator means for comparing a predetermined reference distance with the distances among the child units, and when the distance comparator means has detected the distances among the child units that are smaller than the reference distance, the notifying means notifies this fact.

4. A body-mounted electronic device system according to claim 3, further comprising operation means for setting the reference distance and reference distance storage means for storing the reference distance set by the operation means, and when the distance comparator means has detected that the distances among the child units are in agreement with the reference distance, the notifying means notifies this fact.

5. A body-mounted electronic device system according to claim 3, wherein the reference distance is constituted by a first reference distance and a second reference distance, the distance comparator means produces a first notice signal when the distances among the child units become smaller than the first reference distance, produces a second notice signal when the distances among the child units become smaller than the second reference distance, and the notifying means notifies this fact in different modes in response to the first and second notice signals.

6. A body-mounted electronic device system according to claim 1, wherein the first communication means and the second communication means are so constituted as to communicate with each other in both directions, the master unit includes reception judging means which judges whether the moving quantity data are normally received from the plurality of child units and requests the child units to send the moving quantity data again when the moving quantity data are not normally received from the child units, and the child units include control means for sending the moving quantity data again in response to the request for sending the data again.

7. A body-mounted electronic device system according to claim 1, wherein the master unit has an electronic wrist watch function.

8. A body-mounted electronic device system comprising:

a master unit that can be mounted on the bodies having first communication means for executing radio communication with a plurality of child units, first identification data storage means for storing identification data of the plurality of child units, identification data judging means for judging whether the identification data received from the plurality of child units are in agreement with the identification data of child units stored in the first identification data storage means, difference-of-speed calculation means for calculating differences in the speed among the plurality of child units based on the moving quantity data received from the plurality of child units, estimated catch-up time calculation means for calculating an estimated catch-up time until any child unit catches up another child unit based upon the distances among the child units and the difference of speed among the child units, and notifying means for notifying the estimated catch-up time; and the plurality of child units that can be mounted on the bodies having a second communication means for executing radio communication with the master unit, moving quantity-measuring means for measuring the moving quantity corresponding to its own moving distance, and second identification data storage means for storing its own identification data, wherein each of the plurality of child units transmits its own moving quantity data measured by the moving quantity-measuring means together with its own identification data to the master unit through the second communication means, and when the identification data judging means has judged that the identification data received from the plurality of child units are in agreement with the identification data stored in the first identification data storage means, the master unit causes the estimated catch-up time calculation means to calculate the estimated catch-up time based upon the moving quantity data from the plurality of child units received through the first communication means, and notifies the estimated catch-up time through the notifying means.

9. A body-mounted electronic device system according to claim 8, wherein the difference-of-speed calculation means includes section distance calculation means for calculating the moving distances of the plurality of child units at predetermined reception intervals based upon the moving quantity data received at predetermined reception intervals, moving distance calculation means for calculating the moving speeds of the plurality of child units by dividing, by the predetermined reception intervals, the moving distances of the plurality of child units calculated by the section distance calculation means, and difference-of-speed-among-child-units calculation means for calculating differences in the moving speed among the plurality of child units.

10. A body-mounted electronic device system according to claim 8, wherein the first communication means and the second communication means are so constituted as to communicate with each other in both directions, the master unit includes reception judging means which judges whether the moving quantity data are normally received from the plurality of child units and requests the child units to send the moving quantity data again when the moving quantity data are not normally received from the child units, and the child units include control means for sending the moving quantity data again in response to the request for sending the data again.

11. A body-mounted electronic device system according to claim 8, wherein the master unit has an electronic wrist watch function.

12. A body-mounted electronic device comprising:

communication means for executing radio communication with a plurality of child units;

identification data storage means for storing identification data of the plurality of child units;

identification data judging means for judging whether the identification data received from the plurality of child units are in agreement with the identification data of child units stored in the identification data storage means;

distance calculation means for calculating distances among the plurality of child units from moving quantity data received from the plurality of child units; and notifying means for notifying the distances among the child units, wherein when the identification data judging means has judged that the identification data received from the plurality of child units are in agreement with the identification data stored in the identification data storage means, the distance calculation means calculates the distances among the child units based upon the moving quantity data from the plurality of child units received by the notifying means, and notifies the distances among the child units through the notifying means.

13. A body-mounted electronic device according to claim 12, wherein the distance calculation means includes moving distance calculation means for calculating absolute distances which are the moving distances of the plurality of child units from the start positions, and among-the-child-units-distance calculation means for calculating the distances among the child units from the differences in the absolute distances of the plurality of child units calculated by the moving distance calculation means.

14. A body-mounted electronic device according to claim 12, further comprising distance comparator means for comparing a predetermined reference distance with the distances among the child units, and when the distance comparator means has detected the distances among the child units that are smaller than the reference distance, the notifying means notifies this fact.

15. A body-mounted electronic device according to claim 14, further comprising operation means for setting the reference distance and reference distance storage means for storing the reference distance set by the operation means, and when the distance comparator means has detected that the distances among the child units are in agreement with the reference distance, the notifying means notifies this fact.

16. A body-mounted electronic device according to claim 14, wherein the reference distance is constituted by a first reference distance and a second reference distance, the distance comparator means produces a first notice signal when the distances among the child units become smaller than the first reference distance, produces a second, notice signal when the distances among the child units become smaller than the second reference distance, and the notifying means notifies this fact in different modes in response to the first and second notice signals.

17. A body-mounted electronic device according to claim 12, further comprising difference-of-speed calculation means for calculating differences in the speed among the plurality of child units, and estimated catch-up time calculation means for calculating an estimated catch-up time until any child unit catches up another child unit based upon the distances among the child units and the difference of speed among the child units, and the estimated catch-up time is notified by the notifying means.

18. A body-mounted electronic device according to claim 12, wherein the communication means is so constituted as to execute the communication in two directions, and provision is made of reception judging means which judges whether the moving quantity data are normally received from the child units and requests the child units to send the moving quantity data again when the moving quantity data are not normally received from the child units.

19. A body-mounted electronic device comprising;

communication means for executing radio communication with a plurality of child units, identification data storage means for storing identification data of the plurality of child units;

identification data judging means for judging whether the identification data received from the plurality of child units are in agreement with the identification data of child units stored in the identification data storage means;

difference-of-speed calculation means for calculating differences in the speed among the plurality of child units based on the moving quantity data received from the plurality of child units;

estimated catch-up time calculation means for calculating an estimated catch-up time until any child unit catches up another child unit based upon the distances among the child units and the difference of speed among the child units; and notifying means for notifying the estimated catch-up time, wherein when the identification data judging means has judged that the identification data received from the plurality of child units are in agreement with the identification data stored in the identification data storage means, a master unit causes the estimated catch-up time calculation means to calculate the estimated catch-up time based upon the moving quantity data from the plurality of child units received through the communication means, and notifies the estimated catch-up time through the notifying means.

20. A body-mounted electronic device according to claim 19, wherein the difference-of-speed calculation means includes section distance calculation means for calculating the moving distances of the plurality of child units at predetermined reception intervals based upon the moving quantity data received at predetermined reception intervals, moving distance calculation means for calculating the moving speeds of the plurality of child units by dividing, by the predetermined reception intervals, the moving distances of the plurality of child units calculated by the section distance calculation means, and difference-of-speed-among-child-units calculation means for calculating differences in the moving speed among the plurality of child units.

21. A body-mounted electronic device according to claim 19, wherein the communication means is so constituted as to execute the communication in two directions, and provision is made of reception judging means which judges whether the moving quantity data are normally received from the child units and requests the child units to send the moving quantity data again when the moving quantity data are not normally received from the child units.

* * * * *